US005212925A

United States Patent [19]

McClinton

[11] Patent Number: 5,212,925

[45] Date of Patent: May 25, 1993

[54] WALL CORNER COMPOSITE, MOLD AND METHOD FOR PRODUCING GLAZED UNIT FOR SUCH

[76] Inventor: John McClinton, 7432 Hickory La., Hanover, Md. 21076

[21] Appl. No.: 795,773

[22] Filed: Nov. 21, 1991

[51] Int. Cl.[5] ..... E04C 1/00

[52] U.S. Cl. ..... 52/612; 52/284; 52/594; 52/609; 52/610

[58] Field of Search ..... 52/259, 284, 309.13, 52/309.17, 596, 604, 605, 609, 610, 611, 612, 594

[56] References Cited

U.S. PATENT DOCUMENTS

| | | | |
|---|---|---|---|
| 567,173 | 9/1896 | Schillinger et al. . | |
| 657,802 | 9/1900 | Watson . | |
| 790,480 | 5/1905 | Crouch . | |
| 795,939 | 8/1905 | Shone . | |
| 801,294 | 10/1905 | Zeigler . | |
| 834,573 | 10/1906 | Hall . | |
| 894,122 | 7/1908 | Dougherty | 52/604 |
| 987,319 | 3/1911 | Potter . | |
| 1,297,960 | 3/1919 | Yourtee . | |
| 1,644,587 | 10/1927 | Heltzel . | |
| 1,751,028 | 3/1930 | Caswell et al. . | |
| 2,120,200 | 6/1938 | Davis . | |
| 2,121,450 | 6/1938 | Sentrop . | |
| 2,207,178 | 7/1940 | Richards . | |
| 2,214,657 | 10/1940 | Brown | 52/609 |
| 2,752,275 | 6/1956 | Raskin et al. . | |
| 3,102,367 | 9/1963 | Pedersen et al. . | |
| 3,722,704 | 3/1973 | Piretti . | |
| 3,992,834 | 11/1976 | Valenzano . | |
| 4,031,289 | 6/1977 | Sergovic | 52/612 |
| 4,075,812 | 2/1978 | Koyama et al. | 52/612 |
| 4,614,324 | 9/1986 | Yamashita et al. . | |
| 4,673,159 | 6/1987 | Schmidgall . | |
| 4,909,010 | 3/1990 | Gravier | 52/609 |
| 5,031,376 | 7/1991 | Bender et al. | 52/609 |

FOREIGN PATENT DOCUMENTS

| | | | |
|---|---|---|---|
| 0087006 | 1/1921 | Switzerland | 52/610 |
| 0673467 | 6/1952 | United Kingdom | 52/610 |

*Primary Examiner*—Carl D. Friedman
*Assistant Examiner*—Wynn E. Wood
*Attorney, Agent, or Firm*—Pollock, Vande Sande & Priddy

[57] ABSTRACT

A wall corner composite comprising two glazed angled masonry building units. Each masonry building unit includes a glazed front face including a planar portion that is opposed a back face and a second segment that intersects the planar portion. The second segment forms an obtuse angle with the planar portion and has a length that is equal to or shorter than the length of the planar portion. A side face of the building unit is angled and intersects the second segment and the back face. This side face forms an obtuse angle with the back face and an angle with the second segment of the front face. Also provided is a mold and method for producing glazed masonry building units.

38 Claims, 5 Drawing Sheets

FIG. 2
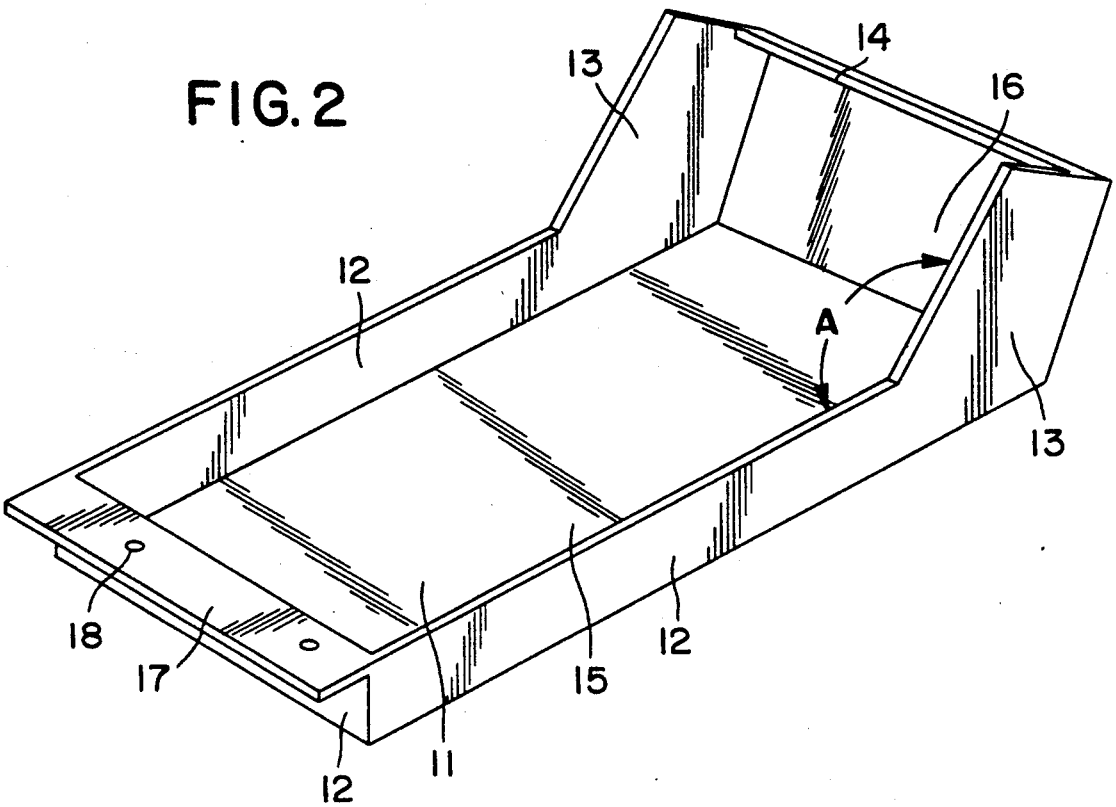
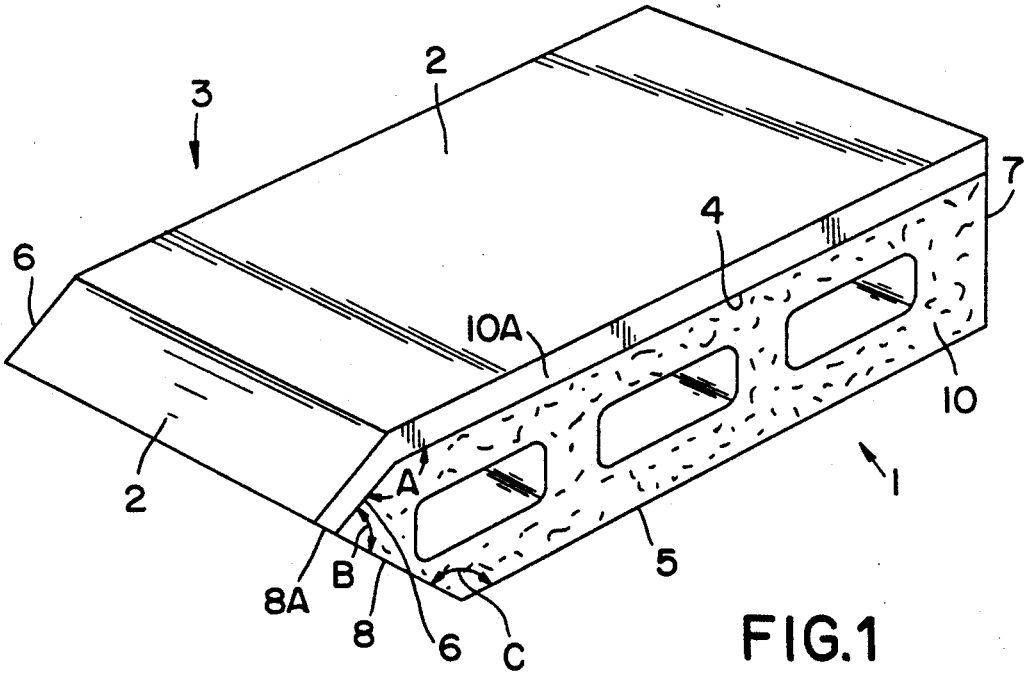
FIG. 1

WALL CORNER COMPOSITE, MOLD AND METHOD FOR PRODUCING GLAZED UNIT FOR SUCH

TECHNICAL FIELD

The present invention is concerned with forming corners in a wall construction containing at least two glazed masonry building units of particular configuration. The present invention is also concerned with a mold and method for providing the glazed masonry building units employed to provide the wall corner construction of the present invention.

BACKGROUND ART

Filled polymeric materials have been known to provide decorative and protective surfaces to walls. For instance, it has been known to coat masonry units filled with polyesters and to form walls therefrom. The basic patent on the use of polyester as coatings for masonry units is U.S. Pat. No. 2,751,775 to Sergovic and assigned to the assignee of the present application. Over the years, a number of improvements in the coating compositions for the masonry building units have been developed. For instance, U.S. Pat. No. 3,328,231 to Sergovic and assigned to the assignee of the present application, discloses a glazed masonry building block made of a cured composition of an unsaturated polyester resin and sand in which the sand comprises at least 50% by weight of the coating composition. The unsaturated polyester is derived from a reaction between a dicarboxylic acid, such as phthalic, maleic, fumaric, adipic, pimelic, suberic, itaconic, citraconic, succinic acids, and/or an anhydride thereof, and a polyhydric alcohol such as ethylene glycol, diethylene glycol, and propylene glycol. Also present in such compositions is an unsaturated monomer, such as methyl methacrylate, styrene, diallyl phthalate, t-butyl styrene, and alphamethyl styrene. Furthermore, U.S. Pat. No. 4,031,289 to Sergovic discloses coated masonry building blocks, articles and compositions therefore that employ various pigments and chemicals in combination with various resinous compositions to provide stain resistance when subjected to high moisture conditions and/or staining media. The disclosures of the above mentioned U.S. Pat. Nos. 2,751,775, 3,328,231 and 4,031,289 are incorporated herein by reference.

Constructing walls with glazed masonry building units presents particular problems with respect to the formation of the outside corners of the wall structures. For example, glazed cinder or concrete blocks at corners and intersecting wall planes must be glazed on more than one side, in particular one face and one end or one face and one top provided that they are intersecting, in order for the glaze material to show when turning a corner. However, attempts to glaze two intersecting sides of a masonry block have not been entirely successful and have suffered from a number of problems. For example, the percent of factory culls or rejects generated when making a corner or cap block with two or more surfaces glazed simultaneously is significantly greater than the percent of culls generated when glazing a single face or plane to form a straight wall unit (referred to in the art as "stretchers").

The vertical space between the end of the mold and the concrete block requires special care to assure the removal of entrapped air while filling the space with the glazing material. This results in air bubbles which become pinholes in the return end of corner units. Also, the differences in sand settlement can cause unsightly lines at the intersecting planes of the corner.

Rejected glazed corner blocks result in a 5% to about 10% loss as compared to only a 0.5% to about 2% loss for coated "stretchers." In particular, defects in the finished products are manifested as the formation of unsightly lines at the intersecting planes of the decorative surfaces of the corner units, unsightly pin holes and differences in the color appearance between the intersecting surface planes of such blocks.

One attempt to overcome the problems associated with constructing the outside corners is disclosed in U.S. Pat. No. 4,329,822 to Russell and assigned to the assignee of the present application. In particular, U.S. Pat. No. 4,329,822 discloses a corner wall facing unit that includes a unit that it is not supported by a concrete block and must be supported using a non-block supported wall system or wire mesh and are time-consuming to erect. Although such a system has been quite effective, such non-self-supporting units tended to be relatively heavy for their size which requires the use of temporary wedges to prevent slippage and sagging in the mortar used between the wall units during erection. Also, such units require special installation care, and do not assure structural integrity equal to this system and other conventional systems.

Moreover, turning a corner, e.g. a 90° corner or more, has been carried out by employing a single piece angled glazed block in conjunction with a glazed straight wall unit (see FIG. 7). Such a corner would be used to create a wall angle in the exposed face by employing only one angled glazed block and will always be connected to a straight wall unit without the use of a second corner piece or angled glazed block. The return employed on these prior angled glazed blocks are relatively deep, i.e. at least about 3¾". The use of such a single piece angled glazed block normally requires a fill piece adding to the complexity of the arrangement. The prior angled glazed blocks are merely an angled version of the 90° 4", 6", 8" or 12" single corner square or rounded units.

SUMMARY OF INVENTION

The present invention overcomes many of the problems in the prior art and provides for a system that utilizes a composite or construction of two glazed angled masonry units for constructing a corner, which exhibits a superior looking wall and corner along with a higher level of acceptance at the job site and a reduced percentage of rejected materials at the manufacturing site. Moreover, when two walls intersect at right angles the present invention provides for eliminating a mortar joint at the extreme corner if corners are mitred and moves the mortar joint to a flat plane connecting the two intersecting wall planes. This is more architecturally aesthetic than the traditional mortar joint falling directly at the extreme intersection of the two planes. In addition, the present invention makes it possible to achieve the benefits of a mitre joint on the integral wall construction without the problems of having a mortar joint visible at the extreme corner of the construction, and without using the connecting unit of U.S. Pat. No. 4,329,822 as a spacer to turn the corner.

In addition, the present invention provides for having self-supporting main wall units integrated.

More particularly, the present invention is concerned with a wall corner composite employing at least two glazed angled concrete block masonry building units wherein a non-interlocking joint is formed therebetween. Each of the glazed raw block masonry building units include a front face, a back face, a top face, a bottom face and two side faces. To form the glazed masonry unit, the front face is glazed with a resinous composition and is intended to be exposed as the main wall unit and includes a planar surface that is opposite the back face and preferably extends parallel to the back face (raw block) and a second glazed surface that intersects the planar portion at a right, obtuse or acute angle. The length of the second segment is generally shorter than length of the planar portion of the front face, and is preferably 2½" or less. One of the side faces of the masonry building unit is angled and intersects the second segment of the front face and also intersects the back face. This face forms an obtuse angle with the back face. This face can form a right angle, an acute or an obtuse angle with the second segment of the front face. It is also preferred according to the present invention that a return edge or lip of a minor portion of the angled side wall that intersects the front face is also glazed. The angled return portions of the glazed masonry units face each other.

The reference to the location of the faces of the unit such as front, back, top, bottom and side is used herein to denote the relationship of the various faces to each other but is not intended to denote the orientation of the unit in a particular building construction.

A further aspect of the present invention is concerned with a mold that is suitable for the fabrication of glazed masonry building units. In particular, the mold includes a bottom portion having a horizontal planar segment and an angled segment that intersects the horizontal planar segment at an angle. The mold also includes sidewalls and a back flange. The flange is located at the end of the mold farthest from the angled segment.

A still further aspect of the present invention is concerned with a method for fabricating a glazed masonry unit. The method incudes applying a glaze composition to the horizontal planar bottom inner surface of the mold described hereinabove. A shaped masonry unit is then placed in the mold. The masonry unit has a front face that includes a planar portion and an angled segment that generally corresponds to the horizontal planar segment and angled segment of the mold. Glaze composition is also added in the cavity formed between the masonry unit and mold along the inside of the angled segment of the mold. The glaze composition is then cured. The glazed masonry unit is removed from the mold by inverting or turning the mold with the block therein over and then by applying pressure to the flange of the mold, the mold is lifted off from the glazed masonry unit. It is essential that the pressure is applied to the flange at the back end for release of those masonry units having a negative return such as the glazed lip portion.

SUMMARY OF DRAWINGS

FIG. 1 is an isometric view of a glazed masonry unit pursuant to the present invention.

FIG. 2 is an isometric view of a mold suitable for obtaining the glazed masonry unit pursuant to the present invention.

BEST AND VARIOUS MODES FOR CARRYING OUT INVENTION

Figure 3:
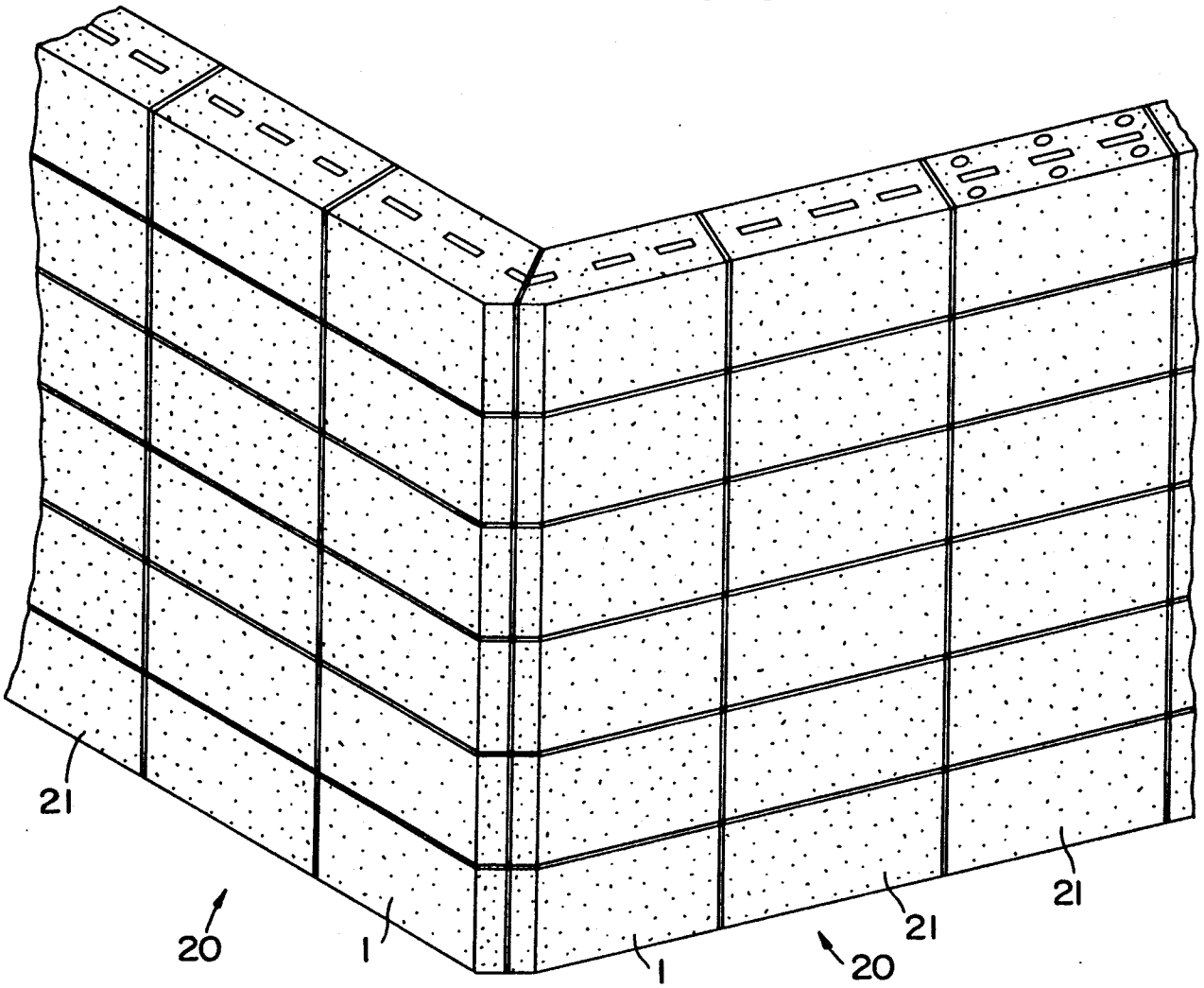
FIG. 3 is an isometric view of a section of a wall pursuant to the present invention.
Figure 4:
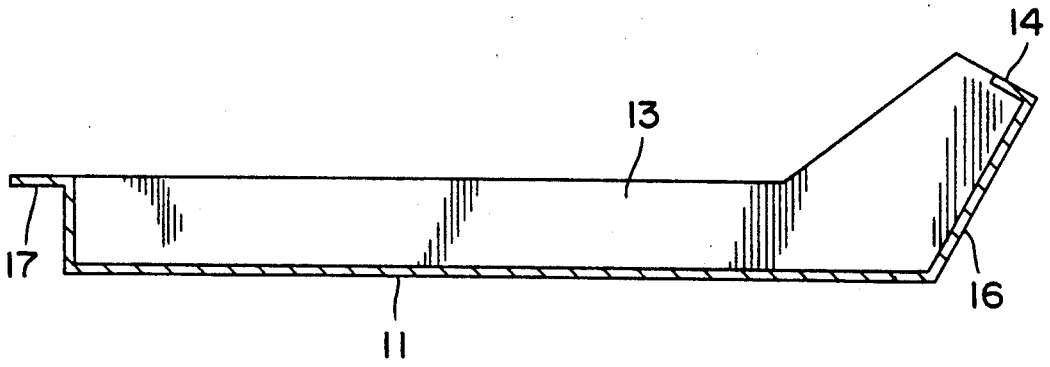
FIG. 4 is a side view of the mold of FIG. 2.
Figure 5:
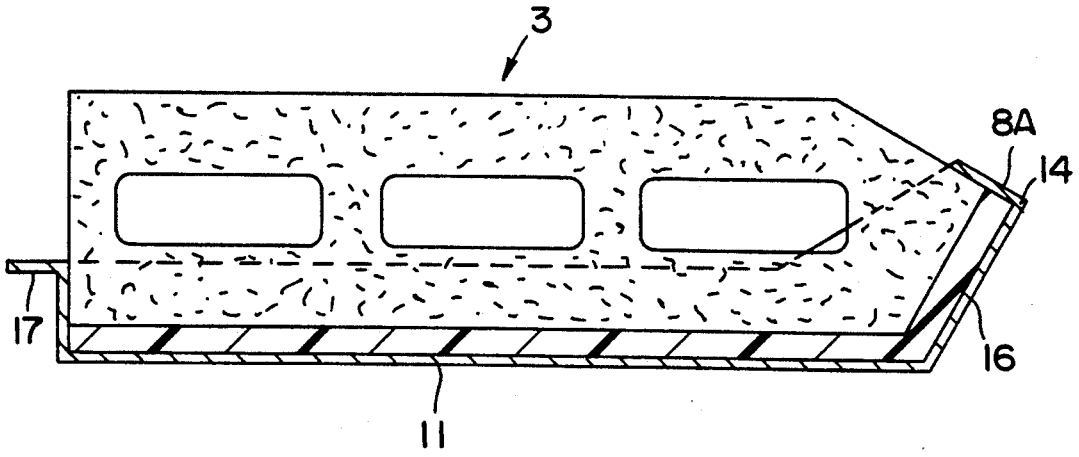
FIG. 5 is a side view of the mold containing the glazing composition and a masonry unit.

In order to facilitate an understanding of the present invention, reference is made to the figures. In particular, FIG. 1 is an isometric view of a glazed masonry unit pursuant to the present invention that includes a glaze 2 on the front face 3 of the masonry block 1. Examples of suitable glaze compositions are based upon the unsaturated polyester resin compositions disclosed in U.S. Pat. Nos. 2,751,775, 3,328,231, 3,632,725, 4,031,289, and 4,329,822, the entire disclosures of which are hereby incorporated by reference and relied upon. The masonry block 1 can be made from those materials employed to produce masonry block such as cinders, slag, cement, haydite, clay, or the like. This glazed front face of the masonry block is that face which is intended to be exposed to the environment in which the block is employed in a building application. The front face of the masonry block includes a planar portion 4 that is opposite to and preferably extends parallel to a back face 5. The front face also includes a second segment 6 that intersects the planar portion 4 at an obtuse, acute or right angle A depending upon the angle of the desired corner. In a preferred aspect according to the present invention, angle A is obtuse and most preferably about 135°.

In addition, it is essential in achieving the desired results obtained by the present invention that the second segment of the front face or return be shorter than the planar portion of the front face and preferably have a length that is about 75% or less of the planar portion of the front face, more preferably about 5% to about 50% of the planar portion of the front face and most preferably about 5% to 25% of the planar portion of the front face. Preferably, the second segment or return 6 is 2½" or less and usually at least about ½" and most preferably about 1" to about 2".

The reduction in unacceptable coatings such as ones having holes and/or color differences or formation of lines at the corner is quite significant when employing a shallow return 6, about 2½" or less pursuant to the preferred aspects of the present invention.

Figure 7:
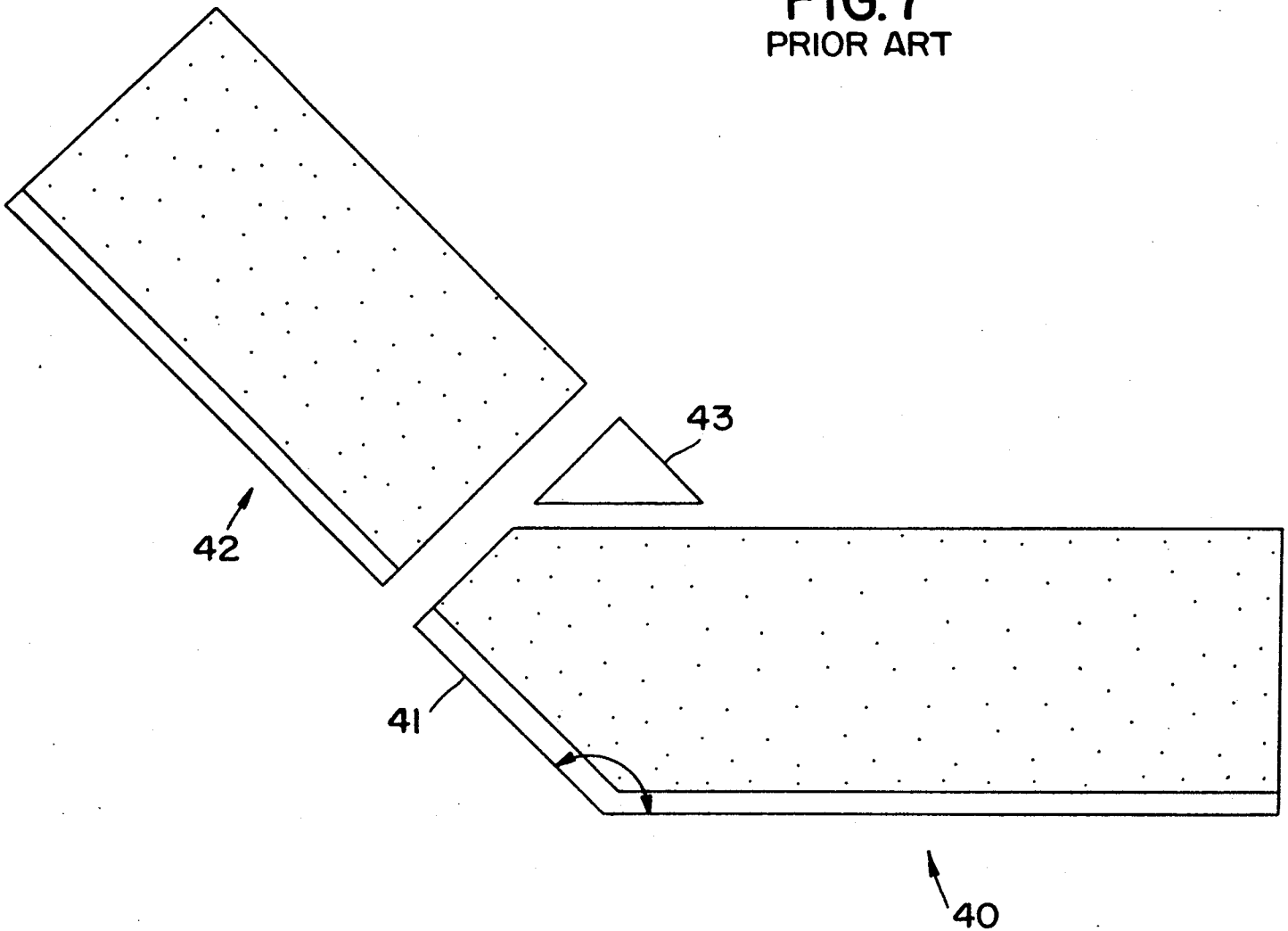
FIG. 7 PRIOR ART
FIG. 7 is a side view of a prior art corner turn.

Contrary to employing a shallow return, the prior art exemplified in FIG. 7 employed a relatively deep return 41 of at least about 3¾". Moreover, these prior art angled glazed blocks have been used only for turning a corner, and not for creating a high quality corner design such as a 90° turn as achieved by the present invention. Although such angled blocks have been in use for at least 15 years, such have merely been used as a single unit to turn the corner as contrasted to using two angled units together according to the present invention. The angled prior art unit 40 has been used in conjunction with a straight wall unit 42 and typically, but not necessarily, a fill 43.

Moreover, with the standard concrete blocks, employing a 2½" or less return, the wall thickness at the intersection of the two units is sufficiently thick to provide a stable corner, particularly when using a wall tie. On the other hand, as the return portion increases above this level, the wall thickness at the intersection decreases to the extent that it tends to become destabilized.

Figure 6:
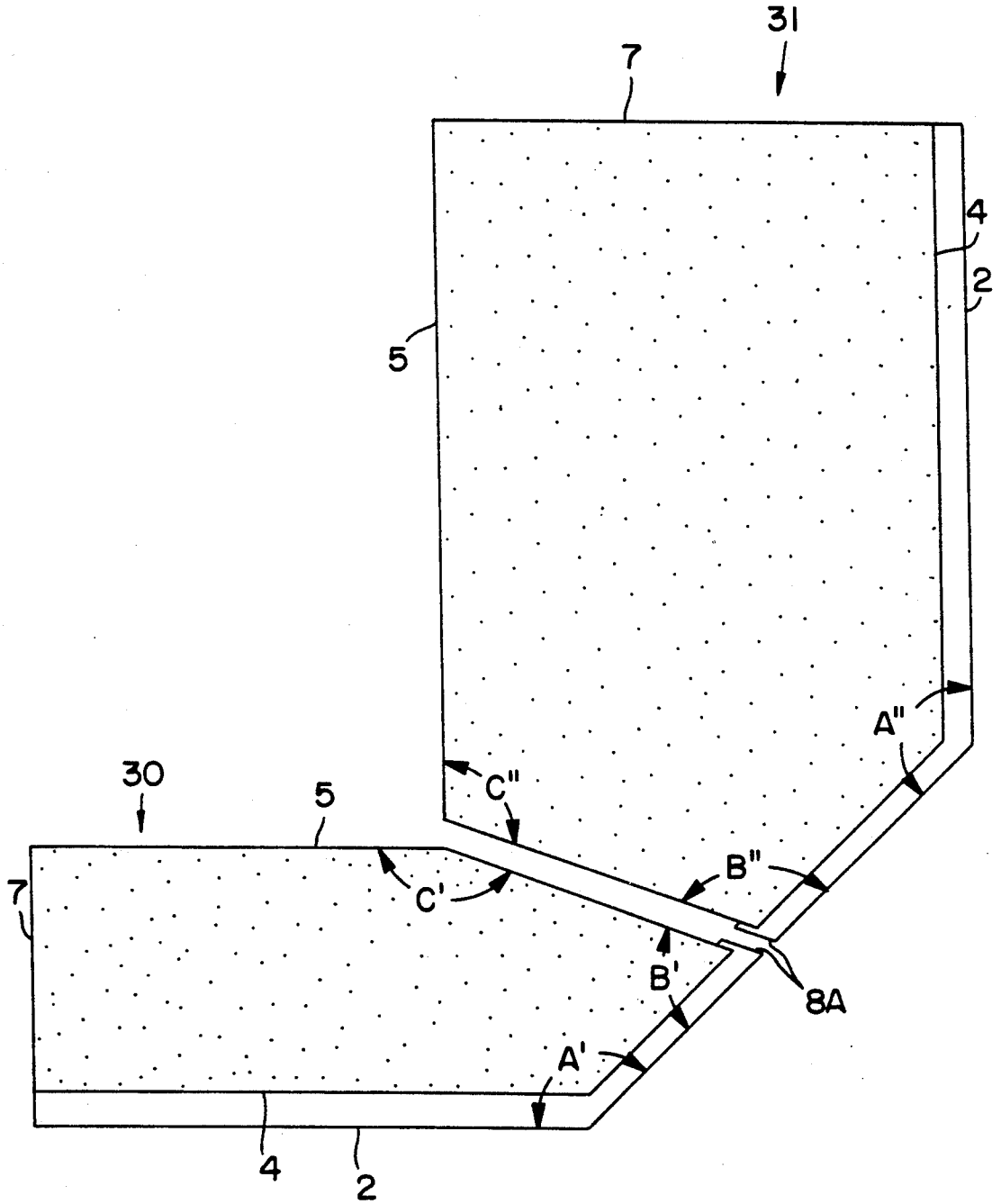
FIG. 6 is a top elevational view of two adjoining angled masonry unit that are of different thicknesses.

Side face 8 is angled and intersects the back face 5 and second segment 6 of the front face 3. Side face 8 forms an obtuse angle C with the back face 5, and in preferred aspect of the present invention, angle C is about 135°. In addition, side face 8 forms an angle B with the second segment 6 which can be a right angle, an acute angle or an obtuse angle depending upon the intended use of the block. In the most preferred aspects of the present invention, angle B is about 90°. However, it may be acute or obtuse depending upon its intended use. For instance, when two angled blocks of the present invention of different thicknesses are to be used adjacent each other to turn a corner, angle B of one block will be acute or obtuse depending upon the relative thicknesses of the blocks. For example, see FIG. 6 where a nominal 4" block 30 is used with a nominal 8" block 31. The sum of angles A' and A" will be about 270° regardless of the relative thicknesses of block 30 and block 31. The sum of angles B' and B" will be about 180° regardless of the relative thicknesses of blocks 30 and 31. The sum of angles C' and C" will be about 270°.

According to preferred aspects of the present invention, a return edge or lip of a minor portion 8A of angled side wall 8 that intersects the second segment of the front face is also glazed. Typically this glazed portion 8A is about ⅛ inch to about 1 inch regardless of the length of side wall 8. The glazed portion 8A provides for a more finished look to the corner since there is a molded corner at the point of intersecting sides 6 and s and also providing a joint that is less susceptible to chipping.

In addition, in a preferred aspect of the present invention, a minor portion 10A of top face 10 (see FIG. 1) is also glazed With the glazing composition. Typically this glazed portion 10A is about ½ inch to about 1 inch regardless of the width of the top face. The bottom face (not shown) is opposite the top face and preferably parallel to the top face as in conventional masonry units.

The length of the second segment (return) 6 is shorter than that of the side face 7 and is preferably about 75% or less of the length of the side face 7 and more preferably about 5% to about 50% of the side face 7, and most preferably about 5% to about 25% of the side face 7.

Reference to FIG. 3 shows a wall 20 including mating pairs of coated masonry blocks 1 of the present invention along with standard blocks 21. As noted, the joint between the mating blocks is not at the corner but rather on the flat portion after the turn. FIG. 2 illustrates a mold that can be employed for glazing the masonry blocks pursuant to the present invention. In particular, the mold includes a pan or a bottom portion 11, sidewalls 12, enlarged angled sidewall portion 13 and a lip portion 14 at the head end 16 of the bottom portion. The enlarged angled sidewall portion 13 is not required but instead is preferred to provide added strength to the mold to prevent bending during the release of the finished product. The enlarged portion also helps to prevent leakage of the coating during the glazing.

Bottom portion 11 includes a horizontal planar segment 15 and an angled segment 16 that intersects segment 15 at an angle (e.g. 135°) corresponding to the angle A of the masonry block to be glazed.

In addition, the lip portion 14 is not required but instead is employed pursuant to preferred embodiment of the present invention to provide for glazing a corresponding portion of the masonry block. This provides for a more finished look to the corner employing the block as well as providing a joint that is less susceptible to chipping.

Moreover, the mold contains a back flange 17. The back flange 17 provides a location where pressure can be applied to the mold for removal of the glazed block upon completion of the processing. Holes 18 in back flange 17 are merely to provide means for hanging the mold for pretreatment such as coating with an enamel, or plating with a metal such as nickel or chrome. The flange typically extends out from the mold from about ¼" to about 1½" and more typically about 1". For ease of manufacture, the flange is typically the same width as is the mold but can be less or more if desired.

The mold employed as apparent to those skilled in the art will be somewhat larger than the block to be glazed in order to accommodate the glaze composition. For a mold to coat a block having an eight (8) inch high nominal front face, the width of the mold will be about 7¾ inches, the side walls will be about ½ inch to about 1 inch, the angle wall portion, when employed will rise at an angle of about 135° to a height of about 0.75 inch to about 3.75 inches or even up to 7¾ inches. The side walls are substantially perpendicular to the bottom portion and typically at about a 93° angle. The lip portion when employed being about ⅛" to about 1" and more typically about ¾" to about ½".

In use, the desired glaze composition is applied to the horizontal portion 15 of the mold to the desired thickness less than the height of the walls 12. Typical glaze thicknesses on face 6 are about ⅛" to about ¾" and on face 2 are about ⅛" to about ¾". Also typical compositions are in the form of relatively viscous slurries having a ratio of filler to liquid of about 2.5:1 to about 7:1 and more typically about 4.0:1 to about 4.5:1. The glaze composition can be uniformly distributed over the horizontal bottom surface of the mold by employing a mechanical device such as a shaker and vibrator as known in the art. Next the shaped block is placed in the mold. The block can either be premolded to the desired shape or can be cut from a standard rectangular shaped block.

According to preferred aspects of the present invention, aggregate, typically sand, is then placed around the edges of the block between the inside of sidewalls 12 and the block, and filled to the top of mold. The aggregate typically has a particle size of about 30 to about 150 mesh. The aggregate is wetted by a wicking action from the slurry and facilitates glazing of the block.

After this, putty such as that commercially available, clay, or more commonly modelling clay, is securely placed between the block and the edge of the mold along the sidewall of the angled portion of the mold. The glazing composition is then poured into the cavity remaining between the block and mold along the inside of the angled portion of the mold for glazing of the angled segment of the block. The lip provides for glazing of the corresponding portion of the block. The putty or clay helps in conjunction with the block to maintain the slurry in place for glazing of the block, while filling and going through the cure cycle.

After this, the glazing composition is cured. The curing can be carried out at room temperature, if desired, depending upon the specific composition selected. Preferably, it is carried out at an elevated temperature of about 150° F. to about 450° F. and more preferably at about 280° F. to about 320° F. Typically, the temperature of the coating is raised to these levels in about 10–30 minutes and held there for sufficient time such as 2–5 minutes to complete polymerization.

An advantage of the present invention is that the entire glazing can be cured in less time as compared to glazing two adjacent sides of a standard shaped masonry unit. The curing can be accomplished in the curing cycle presently used to cure polyester glazing compositions on stretcher masonry units.

After the glaze is properly cured, the glazed masonry unit is removed from the mold by turning the mold with the unit therein over and by applying pressure at the flange of the mold to thereby lift off the mold and release the glazed product.

The present invention releases the product from the back end of the mold as contrasted to prior art techniques that release the product from the head end of the mold. By this technique of the present invention, the shaped articles that have a negative return can be produced, which was not possible from prior art technique. As can be appreciated from the above disclosure, the present invention makes it possible to provide corner masonry units that do not require further trimming as experienced with other corner masonry units on the market. All of the needed trimming can be carried out prior to the glazing or coating. The unique concept of stripping the mold in an opposite way from the traditional techniques enable the mold to incorporate a lip in the reverse edge, which actually forms a mold edge which otherwise would have had to been a cut edge lacking the benefits of appearance and uniformity of a premolded edge. Also, the present invention provides for a relatively fast, easy and efficient manner for providing glazed corner masonry units. This in turn results in being able to comply with requests for the corner units in a timely manner.

More particularly, the present invention and, especially the preferred aspects of employing a narrow return, make it possible to provide a corner system employing glazed masonry units that are formed in a manufacturing manner similar to that employed in making a straight wall unit or stretcher. This provides the ease and quality available through stretcher manufacturing techniques as well as the high production speed available using the stretcher manufacturing methods, and also eliminates the traditional problems of pinholes, voids and sand drop out, swirling and color variation associated with deep molded returns on cornering units. The new corner unit that is the subject of the present invention also accelerates the speed and quantity of output possible because the lack of deep molding of a return reduces the cure time needed in a high temperature reaction system by 10% to 33%. Using current molding techniques for a polyester type glazed unit the time for cure will be reduced from about 18 minutes per unit to 12 minutes per unit. The lack of a thick deep molded return will also reduce the risk of extreme thermal shock and stress generated by the catalyzation and heat of cross-linking generated by a thick or deep corner return in either a room temperature or heat accelerated exotherm as the polymer is converted from a liquid to a solid.

Moreover, the present corner masonry units are especially cost efficient as compared to structures used in the prior art.

While the present invention has been described with respect to various preferred aspects thereof, it will be appreciated that the present invention can be implemented in a number of different ways by those skilled in the art once aware of the present disclosure to suit particular requirements. It will be understood that various changes and substitutions may be made within the spirit and scope of the invention as defined in the following claims.

What is claimed is:

1. A wall corner composite comprising at least two glazed angled masonry building units each having an angled return portion and wherein the angled return portions face each other providing for a non-interlocking joint therebetween and wherein each glazed masonry building unit comprises a front face, a back face, a top face, a bottom face and two side faces wherein said front face is glazed with a resinous composition and is intended to be exposed and comprises a planar portion that is opposite to said back face and a second segment that intersects said planar portion to thereby form an obtuse, acute or right angle and wherein the length of said second segment is shorter than the length of said planer portion and is about 2½ inches or less;

one of said side faces being angled and intersecting said second segment and said back face forming an obtuse angle with said back face and forming an angle with said second segment.

2. The wall corner composite of claim 1 wherein the length of said second segment is about 75% or less of the length of said planar portion.

3. The wall corner composite of claim 1 wherein the length of said second segment is about 5% to about 50% of said planar portion.

4. The wall corner composite of claim 1 wherein the length of said second segment is about 5% to about 25% of said planar portion.

5. The wall corner composite of claim 1 wherein the length of said second segment is less than the length of the side face.

6. The wall corner composite of claim 1 wherein the length of said second segment is about 75% or less of the length of said side face.

7. The wall corner composite of claim 1 wherein the length of said second segment is about 5% to about 50% of said side face.

8. The wall corner composite of claim 1 wherein the length of said second segment is about ½ inch to about 2½ inches.

9. The wall corner composite of claim 1 wherein the length of said second segment is about 1 inch to about 2 inches.

10. The wall corner composite of claim 1 wherein a return lip of a minor portion of the angled side wall that intersects said front face is also glazed.

11. The wall corner composite claim 10 wherein a minor portion of the top face or bottom face or both is glazed.

12. The wall corner composite of claim 11 wherein said minor portion is about ½ inch to about 1 inch.

13. The wall corner composite of claim 1 wherein a minor portion of the top face or bottom face or both is glazed.

14. The wall corner composite of claim 13 wherein said minor portion is about ½ inch to about 1 inch.

15. The wall corner composite of claim 10 wherein said return lip is about ⅛ inch to about 1 inch.

16. The wall corner composite of claim 1 wherein the angle at the intersection of the second segment of the front face and planar portion of the front face is an obtuse angle.

17. The wall corner composite of claim 16 wherein the obtuse angle at the intersection of the angled side face and said back face is about 135°.

18. The wall corner composite of claim 1 wherein the obtuse angle at the intersection of the angled side face and said back face is about 135°.

19. The wall corner composite of claim 17 wherein the angle at the intersection of the angled side face and said second segment of said front face is about 90°.

20. The wall corner composite block of claim 1 wherein the angle at the intersection of the angled side face and said back face is about 90°.

21. The wall corner composite of claim 1 wherein the said glazed masonry building units are of different thicknesses.

22. The wall corner composite of claim 21 wherein the adjacent angled blocks such that the angle at the intersection of the planar portion and second segment of each block is about 135°; the sum of the angle of each block at the intersection of the angled side face and back face is about 270° and the sum of the angle of each block at the intersection of the angled side face and second segment of the front face is about 180°.

23. A wall corner composite comprising at least two glazed angled masonry building units each having an angled return portion and wherein the angled return portions face each other providing for a non-interlocking joint therebetween and wherein each glazed masonry building unit comprises a front face, a back face, a top face, a bottom face and two side faces wherein said front face is glazed with a resinous composition and is intended to be exposed and comprises a planar portion that is opposite to said back face and a second segment that intersects said planar portion to thereby form an obtuse, acute or right angle and wherein the length of said second segment is shorter than the length of said planer portion;

one of said side faces being angled and intersecting said second segment and said back face forming an obtuse angle with said back face and forming an angle with said second segment, and wherein a return lip of a minor portion of the angled side wall that intersects said front face is glazed.

24. The wall corner composite of claim 23 wherein the length of said second segment is about 75% or less of the length of said planar portion.

25. The wall corner composite of claim 23 wherein the length of said second segment is about 5% to about 50% of said planar portion.

26. The wall corner composite of claim 23 wherein the length of said second segment is about 5% to about 25% of said planar portion.

27. The wall corner composite of claim 23 wherein a minor portion of the top face or bottom face or both is glazed.

28. The wall corner composite of claim 27 wherein said minor portion is about ½ inch to about 1 inch.

29. The wall corner composite of claim 23 wherein said return lip is about ⅛ inch to about 1 inch.

30. The wall corner composite of claim 1 wherein the angle at the intersection of the second segment of the front face and planar portion of the front face is about 135°.

31. The wall corner composite of claim 23 wherein the obtuse at the intersection of the second segment of the front face and planar portion of the front face is about 135°.

32. The wall corner composite of claim 23 wherein the angle at the intersection of the second segment of the front face and planar portion of the front face is obtuse.

33. The wall corner composite of claim 31 wherein the obtuse angle at the intersection of the angled side face and said back face is about 135°.

34. The wall corner composite of claim 23 wherein the obtuse angle at the intersection of the angled side face and said back face is about 135°.

35. The wall corner composite of claim 34 wherein the angle at the intersection of the angled side face and said second segment of said front face is about 90°.

36. The wall corner composite of claim 23 wherein the angle at the intersection of the angled side face and said back face is about 90°.

37. The wall corner composite of claim 23 wherein the said glazed masonry building units are of different thicknesses.

38. The wall corner construction of claim 37 wherein the adjacent angled blocks such that the angle at the intersection of the planar portion and second segment of each block is about 135°; the sum of the angle of each block at the intersection of the angled side face and back face is about 270° and the sum of the angle of each block at the intersection of the angled side face and second segment of the front face is about 180°.

* * * * *